US010718324B2

(12) United States Patent
Nakano et al.

(10) Patent No.: US 10,718,324 B2
(45) Date of Patent: Jul. 21, 2020

(54) BELLOWS PUMP APPARATUS

(71) Applicant: NIPPON PILLAR PACKING CO., LTD., Osaka (JP)

(72) Inventors: Atsushi Nakano, Osaka (JP); Keiji Nagae, Osaka (JP)

(73) Assignee: NIPPON PILLAR PACKING CO., LTD., Osaka (JP)

( * ) Notice: Subject to any disclaimer, the term of this patent is extended or adjusted under 35 U.S.C. 154(b) by 218 days.

(21) Appl. No.: 15/527,245

(22) PCT Filed: Jul. 6, 2015

(86) PCT No.: PCT/JP2015/069449
§ 371 (c)(1),
(2) Date: May 16, 2017

(87) PCT Pub. No.: WO2016/103768
PCT Pub. Date: Jun. 30, 2016

(65) Prior Publication Data

US 2017/0350382 A1 Dec. 7, 2017

(30) Foreign Application Priority Data

Dec. 25, 2014 (JP) ..... 2014-262753

(51) Int. Cl.
*F04B 43/10* (2006.01)
*F04B 43/113* (2006.01)
(Continued)

(52) U.S. Cl.
CPC ..... *F04B 43/10* (2013.01); *F04B 11/00* (2013.01); *F04B 11/0058* (2013.01);
(Continued)

(58) Field of Classification Search
CPC ..... F04B 11/00; F04B 11/0058; F04B 43/10; F04B 43/0081; F04B 43/113;
(Continued)

(56) References Cited

U.S. PATENT DOCUMENTS 4,021,156 A * 5/1977 Fuchs, Jr. ..... F01L 25/063 417/346
4,534,044 A * 8/1985 Funke ..... G11B 20/1419 331/1 A
(Continued)

FOREIGN PATENT DOCUMENTS

CN 102057160 A 5/2011
JP H08296564 A 11/1996
(Continued)

OTHER PUBLICATIONS

Search Report for corresponding CN Application 2015-80070335.3 dated Aug. 1, 2018.
(Continued)

*Primary Examiner* — Charles G Freay
(74) *Attorney, Agent, or Firm* — Millen, White, Zelano & Branigan, P.C.; William Nixon

(57) ABSTRACT

The bellows pump device supplies pressurized air to one air chamber of two hermetic air chambers thereby to cause a bellows to perform expansion operation to suck a transport fluid, and supplies pressurized air to the other air chamber thereby to cause the bellows to perform contraction operation to discharge the transport fluid. The bellows pump device includes: an electropneumatic regulator configured to adjust a first air pressure of the pressurized air to be supplied to the one air chamber, and a second air pressure of the pressurized air to be supplied to the other air chamber; and a control unit configured to control the electropneumatic regulator such that, at least at a time point of end of
(Continued)

expansion during expansion operation of the bellows, the first air pressure is lower than the second air pressure.

11 Claims, 11 Drawing Sheets

(51) Int. Cl.

| | |
|---|---|
| ***F04B 45/02*** | (2006.01) |
| ***F04B 11/00*** | (2006.01) |
| ***F04B 43/00*** | (2006.01) |
| ***F04B 49/06*** | (2006.01) |
| ***F04B 45/033*** | (2006.01) |
| *F04B 49/22* | (2006.01) |

(52) U.S. Cl.
CPC ..... *F04B 43/0081* (2013.01); *F04B 43/113* (2013.01); *F04B 45/022* (2013.01); *F04B 45/0336* (2013.01); *F04B 49/065* (2013.01); *F04B 49/22* (2013.01); *F04B 2203/10* (2013.01); *F04B 2205/13* (2013.01)

(58) Field of Classification Search
CPC ..... F04B 43/1136; F04B 45/022; F04B 45/0336; F04B 49/065; F04B 49/22; F04B 2203/10; F04B 2205/13
See application file for complete search history.

(56) References Cited

U.S. PATENT DOCUMENTS

| | | | | |
|---|---|---|---|---|
| 4,666,374 | A * | 5/1987 | Nelson | F04B 11/0058 417/3 |
| 5,224,841 | A | 7/1993 | Thompson | |
| 5,458,470 | A * | 10/1995 | Mannhart | F04B 9/1178 417/517 |
| 6,244,838 | B1 * | 6/2001 | Couillard | F04B 11/0058 417/426 |
| 6,364,640 | B1 | 4/2002 | Nishio et al. | |
| 7,771,174 | B2 * | 8/2010 | Lenhart | F04B 15/023 417/53 |
| 8,083,493 | B2 * | 12/2011 | Hagg | A61B 17/3203 417/2 |
| 8,613,606 | B2 | 12/2013 | Katsura | |
| 8,991,658 | B2 | 3/2015 | Saito | |
| 9,341,171 | B2 | 5/2016 | Fourneron et al. | |
| 2004/0219044 | A1 * | 11/2004 | Kawamura | F04B 11/00 417/569 |
| 2006/0165541 | A1 | 7/2006 | Teshima | |
| 2011/0318207 | A1 | 12/2011 | Katsura et al. | |
| 2013/0287598 | A1 | 10/2013 | Fourneron et al. | |
| 2014/0054318 | A1 | 2/2014 | Saito | |

FOREIGN PATENT DOCUMENTS

| | | | |
|---|---|---|---|
| JP | 11-324926 | A | 11/1999 |
| JP | 11324926 | A | 11/1999 |
| JP | 2000002187 | A | 1/2000 |
| JP | 2001123959 | A | 5/2001 |
| JP | 2009030442 | A | 2/2009 |
| JP | 2010196541 | A | 9/2010 |
| WO | 2010143469 | A1 | 12/2010 |
| WO | 2012059427 | A1 | 5/2012 |

OTHER PUBLICATIONS

International Search Report for PCT/JP2015/069449 dated Oct. 6, 2015.
English Abstract of JP11-324926, Publication Date: Nov. 26, 1999.
English Abstract of JP2000-002187, Publication Date: Jan. 1, 2000.
English Abstract of WO2010143469, Publication Date: Dec. 16, 2010.
Supplementary European Search Report for EP-15872337 dated Jul. 24, 2018.
English Translation of claims and abstract for JP2009030442, Publication Date: Feb. 12, 2009.
English Translation of claims and abstract for JPH08296564, Publication Date: Nov. 12, 1996.

* cited by examiner

BELLOWS PUMP APPARATUS

TECHNICAL FIELD

The present invention relates to a bellows pump device.

BACKGROUND ART

As a bellows pump used for feeding a transport fluid such as a chemical solution or a solvent in semiconductor production, chemical industries, or the like, a bellows pump has been known which is configured to supply pressurized air to one air chamber of two hermetic air chambers thereby to cause a bellows to perform expansion operation to suck a transport fluid, and supply pressurized air to the other air chamber thereby to cause the bellows to perform contraction operation to discharge the transport fluid, for example, as disclosed in PATENT LITERATURE 1.

In such a bellows pump, the air pressure of the pressurized air to be supplied to each air chamber is generally increased in order to increase the discharge flow rate of the transport fluid. However, if the air pressure is increased, when switching is made from suction of the transport fluid by expansion operation of the bellows to discharge of the transport fluid by contraction operation of the bellows, a great pressure variation (pressure rise) occurs instantaneously, so that an impact pressure called "water hammer" is generated. When the impact pressure is generated, vibration caused by the impact pressure may be transmitted to a pump, a pipe, or a device to break the pump or the like. In addition, boiling (vapor, cavitation, etc.) of a liquid may occur due to an increase in a negative pressure during suction, which may have an adverse effect on a semiconductor production process or the like.

Therefore, in the conventional bellows pump, for example, as disclosed in PATENT LITERATURE 2, a partition wall which is elastically deformable so as to increase the volume in the bellows into which the transport fluid is sucked is provided at an end portion of the bellows as a countermeasure for reducing the impact pressure. When a pressure rise occurs in the bellows, the partition wall elastically deforms thereby to absorb the pressure rise to reduce vibration of the pump or the like.

CITATION LIST

Patent Literature

PATENT LITERATURE 1: Japanese Laid-Open Patent Publication No. 2001-123959

PATENT LITERATURE 2: Japanese Laid-Open Patent Publication No. 2010-196541 (see FIG. 3)

SUMMARY OF INVENTION

Technical Problem

However, in the conventional countermeasure for reducing the impact pressure, it is necessary to produce a dedicated bellows having an elastically deformable partition wall, and thus it is difficult to adopt such a bellows in an already-installed bellows pump.

The present invention has been made in view of such a situation, and an object of the present invention is to provide a bellows pump device that allows an impact pressure generated when switching is made from suction of a working fluid to discharge of the working fluid, to be easily reduced even with an already-installed bellows pump.

Solution to Problem

A bellows pump device of the present invention is a bellows pump device that supplies pressurized air to one air chamber of two hermetic air chambers thereby to cause a bellows to perform expansion operation to suck a transport fluid, and supply pressurized air to the other air chamber thereby to cause the bellows to perform contraction operation to discharge the transport fluid, the bellows pump device including: an electropneumatic regulator configured to adjust a first air pressure that is an air pressure of the pressurized air to be supplied to the one air chamber, and a second air pressure that is an air pressure of the pressurized air to be supplied to the other air chamber; and a control unit configured to control the electropneumatic regulator such that, at least at a time point of end of expansion during expansion operation of the bellows, the first air pressure is lower than the second air pressure.

According to the bellows pump device configured as described above, the first air pressure of the pressurized air to be supplied to the one air chamber during expansion of the bellows is adjusted by the electropneumatic regulator such that, at least at the time point of end of expansion of the bellows, the first air pressure is lower than the second air pressure of the pressurized air to be supplied to the other air chamber during contraction of the bellows. Accordingly, a pressure variation occurring when switching is made from suction of the transport fluid by expansion operation of the bellows to discharge of the transport fluid by contraction operation of the bellows can be reduced, and thus generation of an impact pressure at the time of the switching can be suppressed. In addition, even with an already-installed bellows pump, the impact pressure generated when switching is made from suction of the working fluid to discharge of the working fluid can easily be reduced by adding the electropneumatic regulator and the control unit.

In the above bellows pump device, the control unit preferably controls the electropneumatic regulator such that the first air pressure continuously or discontinuously changes during a period from a time point of start of expansion of the bellows to the time point of end of expansion of the bellows.

In this case, the degree of freedom in pressure change of the first air pressure during the period from the time point of start of expansion of the bellows to the time point of end of expansion of the bellows can be increased.

In the above bellows pump device, the control unit preferably controls the electropneumatic regulator such that the first air pressure is higher during a first half expansion period from the time point of start of expansion to a predetermined halfway time point of the expansion operation than during a second half expansion period from the halfway time point to the time point of end of expansion.

In this case, the expansion speed of the bellows during the first half expansion period from the time point of start of expansion of the bellow to the halfway time point can be higher than the expansion speed of the bellows during the second half expansion period from the halfway time point to the time point of end of expansion. Accordingly, the expansion time of the bellows can be inhibited from becoming excessively long due to the first air pressure becoming low during expansion of the bellows. As a result, the discharge flow rate of the fluid can be inhibited from decreasing.

In the above bellows pump device, the halfway time point is preferably a time point from which the bellows can expand to an expansion end position by an inertial force thereof.

In this case, since the bellows can be caused to expand to the expansion end position by the inertial force thereof from the halfway time point of the expansion operation, the first air pressure can be lower than the air pressure required for the expansion operation of the bellows, during the second half expansion period from the halfway time point to the time point of end of expansion. Accordingly, a pressure variation occurring when switching is made from expansion operation of the bellows to contraction operation of the bellows can be further effectively suppressed.

In the above bellows pump device, the control unit may control the electropneumatic regulator such that the first air pressure is constant from a time point of start of expansion of the bellows to a time point of end of expansion of the bellows.

In this case, the electropneumatic regulator is easily controlled as compared to the case where control is performed such that the first air pressure is continuously or discontinuously changed.

Advantageous Effects of Invention

According to the bellows pump device of the present invention, an impact pressure generated when switching is made from suction of a working fluid to discharge of the working fluid can easily be reduced even with an already-installed bellows pump.

DESCRIPTION OF EMBODIMENTS

Next, preferred embodiments of the present invention will be described with reference to the accompanying drawings.

First Embodiment

<Entire Configuration of Bellows Pump>

Figure 1:
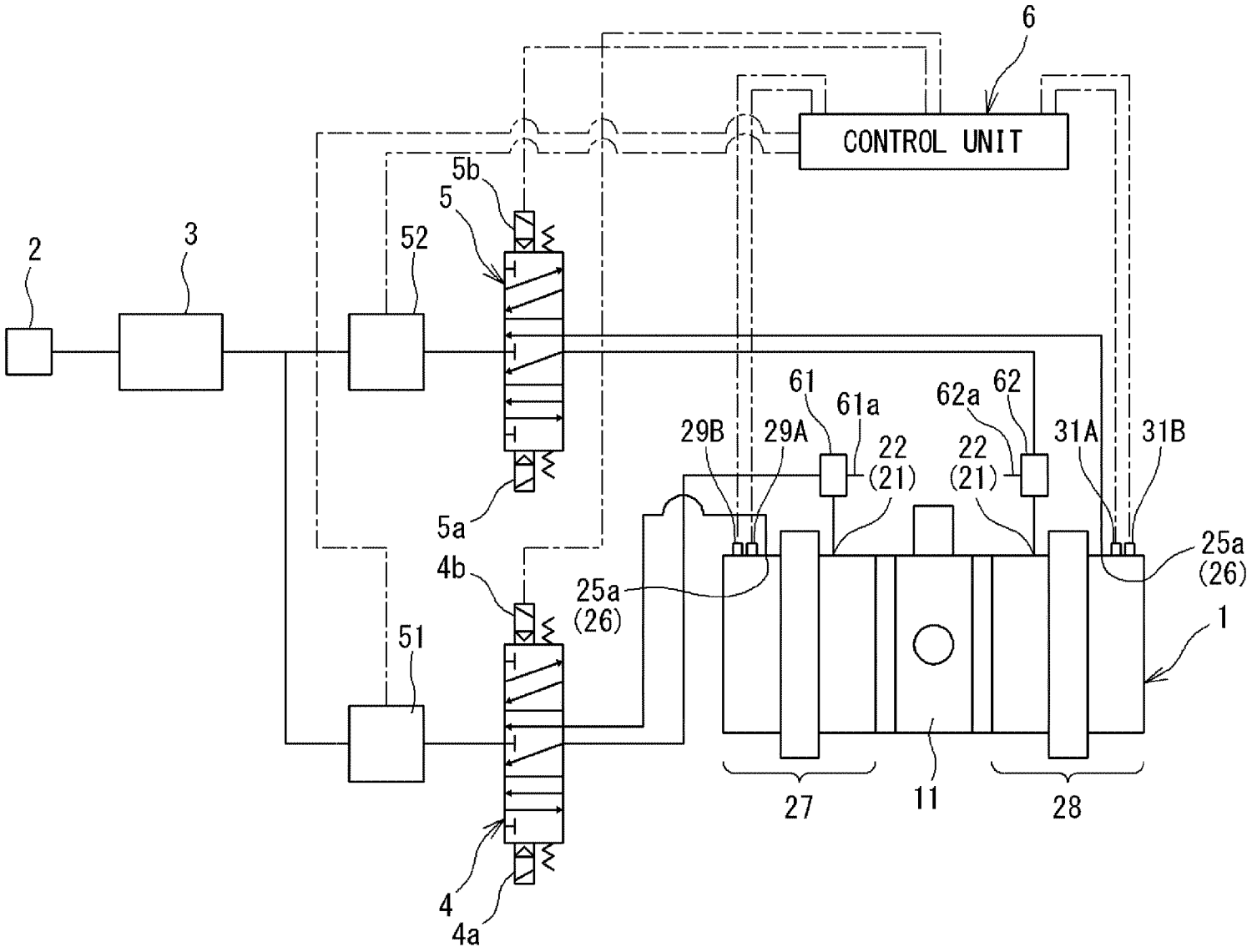
FIG. 1 is a schematic configuration diagram of a bellows pump device according to a first embodiment of the present invention.

FIG. 1 is a schematic configuration diagram of a bellows pump device according to a first embodiment of the present invention. The bellows pump device of the present embodiment is used, for example, in a semiconductor production apparatus when a transport fluid such as a chemical solution or a solvent is supplied in a certain amount. The bellows pump device includes: a bellows pump 1; an air supply device 2 such as an air compressor that supplies pressurized air (working fluid) to the bellows pump 1; a mechanical regulator 3 and two first and second electropneumatic regulators 51 and 52 that adjust the air pressure of the pressurized air; two first and second solenoid valves 4 and 5; and a control unit 6.

Figure 2:
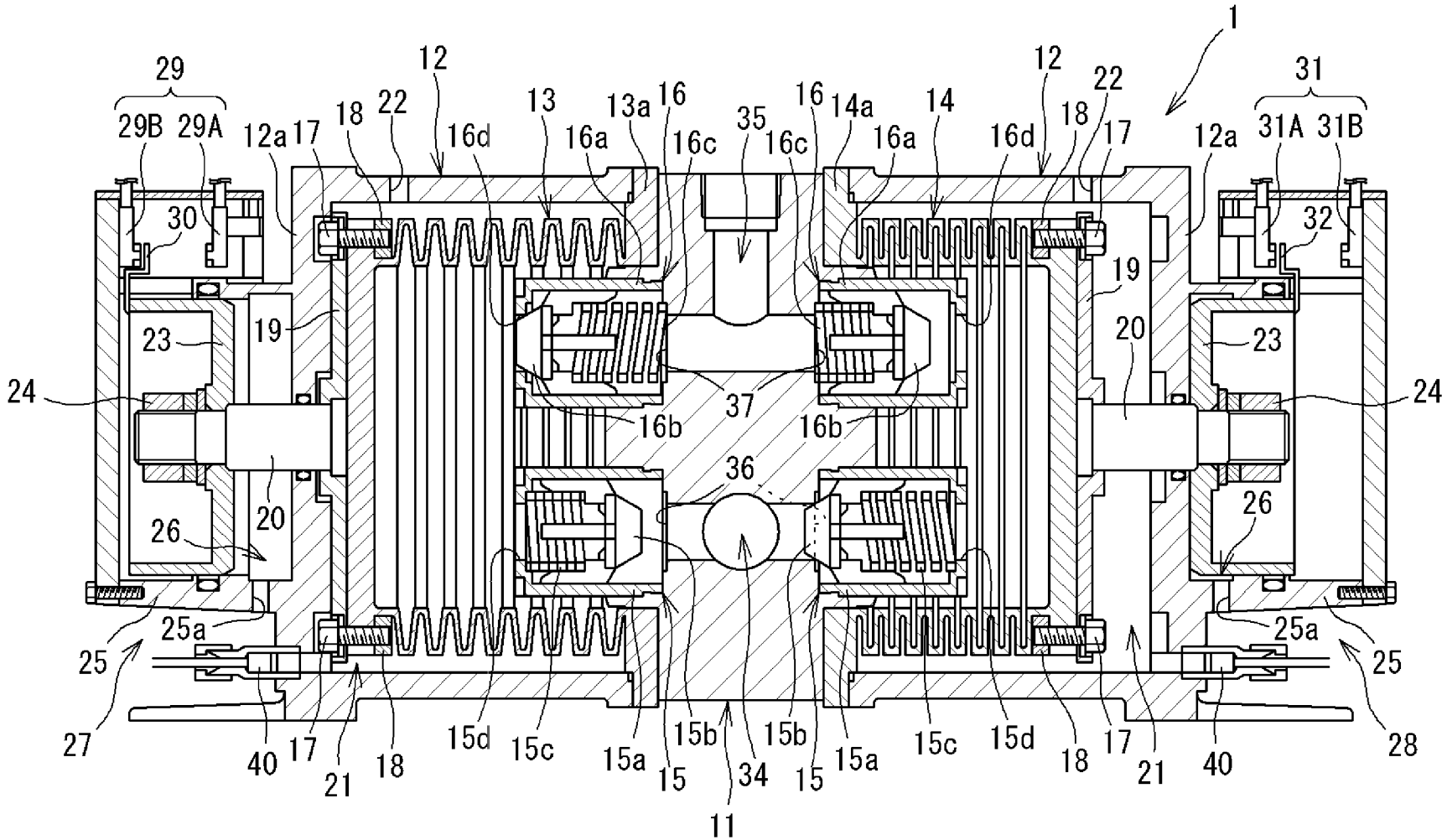
FIG. 2 is a cross-sectional view of a bellows pump.

FIG. 2 is a cross-sectional view of the bellows pump 1 according to the present embodiment.

The bellows pump 1 of the present embodiment includes: a pump head 11; a pair of pump cases 12 that are mounted at both sides of the pump head 11 in a right-left direction (horizontal direction); two first and second bellows 13 and 14 that are mounted on side surfaces of the pump head 11 in the right-left direction and within the respective pump cases 12; and four check valves 15 and 16 that are mounted on the side surfaces of the pump head 11 in the right-left direction and within the respective bellows 13 and 14.

<Configurations of Bellows>

The first and second bellows 13 and 14 are each formed in a bottomed cylindrical shape from a fluorine resin such as polytetrafluoroethylene (PTFE), a tetrafluoroethylene-perfluoro alkyl vinyl ether copolymer (PFA), or the like, and flange portions 13*a* and 14*a* are integrally formed at open end portions thereof and are hermetically pressed and fixed to the side surfaces of the pump head 11. Peripheral walls of the first and second bellows 13 and 14 are each formed in an accordion shape, and are configured to be expandable/contractible independently of each other in the horizontal direction. Specifically, each of the first and second bellows 13 and 14 is configured to expand/contract between a most expanded state where an outer surface of a working plate 19 described later is in contact with an inner side surface of a bottom wall portion 12*a* of the pump case 12 and a most contracted state where an inner side surface of a piston body 23 described later is in contact with an outer side surface of the bottom wall portion 12*a* of the pump case 12.

The working plate 19, together with one end portion of a connection member 20, is fixed to each of outer surfaces of bottom portions of the first and second bellows 13 and 14 by bolts 17 and nuts 18.

<Configurations of Pump Cases>

Each pump case 12 is formed in a bottomed cylindrical shape, and an opening peripheral portion thereof is hermetically pressed and fixed to the flange portion 13*a* (14*a*) of the corresponding bellows 13 (14). Thus, a discharge-side air chamber 21 is formed within the pump case 12 such that a hermetic state thereof is maintained.

A suction/exhaust port 22 is provided in each pump case 12 and connected to the air supply device 2 via the solenoid valve 4 (5), the electropneumatic regulator 51 (52), and the mechanical regulator 3 (see FIG. 1). Accordingly, the bellows 13 (14) contracts by supplying the pressurized air from the air supply device 2 via the mechanical regulator 3, the electropneumatic regulator 51 (52), the solenoid valve 4 (5), and the suction/exhaust port 22 into the discharge-side air chamber 21.

In addition, the connection member 20 is supported by the bottom wall portion 12*a* of each pump case 12 so as to be slidable in the horizontal direction, and the piston body 23 is fixed to another end portion of the connection member 20 by a nut 24. The piston body 23 is supported so as to be slidable in the horizontal direction relative to an inner circumferential surface of a cylindrical cylinder body 25, which is integrally provided on the outer side surface of the bottom wall portion 12*a*, with a hermetic state maintained. Accordingly, a space surrounded by the bottom wall portion 12*a*, the cylinder body 25, and the piston body 23 is formed as a suction-side air chamber 26 of which a hermetic state is maintained.

In each cylinder body 25, a suction/exhaust port 25*a* is formed so as to communicate with the suction-side air chamber 26. The suction/exhaust port 25*a* is connected to the air supply device 2 via the solenoid valve 4 (5), the electropneumatic regulator 51 (52), and the mechanical regulator 3 (see FIG. 1). Accordingly, the bellows 13 (14) expands by supplying the pressurized air from the air supply device 2 via the mechanical regulator 3, the electropneumatic regulator 51 (52), the solenoid valve 4 (5), and the suction/exhaust port 25*a* into the suction-side air chamber 26.

A leakage sensor 40 for detecting leakage of the transport fluid to the discharge-side air chamber 21 is mounted below the bottom wall portion 12*a* of each pump case 12.

Because of the above configuration, the pump case 12 in which the discharge-side air chamber 21 at the left side in FIG. 2 is formed, and the piston body 23 and the cylinder body 25 that form the suction-side air chamber 26 at the left side in FIG. 2, form a first air cylinder portion (first driving device) 27 that causes the first bellows 13 to perform expansion/contraction operation continuously between the most expanded state and the most contracted state.

In addition, the pump case 12 in which the discharge-side air chamber 21 at the right side in FIG. 2 is formed, and the piston body 23 and the cylinder body 25 that form the suction-side air chamber 26 at the right side in FIG. 2, form a second air cylinder portion (second driving device) 28 that causes the second bellows 14 to perform expansion/contraction operation continuously between the most expanded state and the most contracted state.

<Configurations of Detection Device>

A pair of proximity sensors 29A and 29B are mounted on the cylinder body 25 of the first air cylinder portion 27, and a detection plate 30 to be detected by each of the proximity sensors 29A and 29B is mounted on the piston body 23. The detection plate 30 reciprocates together with the piston body 23, so that the detection plate 30 alternately comes close to the proximity sensors 29A and 29B, whereby the detection plate 30 is detected by the proximity sensors 29A and 29B.

The proximity sensor 29A is disposed at such a position that the proximity sensor 29A detects the detection plate 30 when the first bellows 13 is in the most contracted state. The proximity sensor 29B is disposed at such a position that the proximity sensor 29B detects the detection plate 30 when the first bellows 13 is in the most expanded state. Detection signals of the respective proximity sensors 29A and 29B are transmitted to the control unit 6. In the present embodiment, the pair of proximity sensors 29A and 29B form first detection device 29 for detecting an expanded/contracted state of the first bellows 13.

Similarly, a pair of proximity sensors 31A and 31B are mounted on the cylinder body 25 of the second air cylinder portion 28, and a detection plate 32 to be detected by each of the proximity sensors 31A and 31B is mounted on the piston body 23. The detection plate 32 reciprocates together with the piston body 23, so that the detection plate 32 alternately comes close to the proximity sensors 31A and 31B, whereby the detection plate 32 is detected by the proximity sensors 31A and 31B.

The proximity sensor 31A is disposed at such a position that the proximity sensor 31A detects the detection plate 32 when the second bellows 14 is in the most contracted state. The proximity sensor 31B is disposed at such a position that the proximity sensor 31B detects the detection plate 32 when the second bellows 14 is in the most expanded state. Detection signals of the respective proximity sensors 31A and 31B are transmitted to the control unit 6. In the present embodiment, the pair of proximity sensors 31A and 31B form second detection device 31 for detecting an expanded/contracted state of the second bellows 14.

The pressurized air generated by the air supply device 2 is alternately supplied to the suction-side air chamber 26 and the discharge-side air chamber 21 of the first air cylinder portion 27 by the pair of proximity sensors 29A and 29B of the first detection device 29 alternately detecting the detection plate 30. Accordingly, the first bellows 13 continuously performs expansion/contraction operation.

In addition, the pressurized air is alternately supplied to the suction-side air chamber 26 and the discharge-side air chamber 21 of the second air cylinder portion 28 by the pair of proximity sensors 31A and 31B of the second detection device 31 alternately detecting the detection plate 32. Accordingly, the second bellows 14 continuously performs expansion/contraction operation. At this time, expansion operation of the second bellows 14 is performed during contraction operation of the first bellows 13, and contraction operation of the second bellows 14 is performed mainly during expansion operation of the first bellows 13. By the first bellows 13 and the second bellows 14 alternately repeating expansion/contraction operation as described above, suction and discharge of the transport fluid to and from the interiors of the respective bellows 13 and 14 are alternately performed, whereby the transport fluid is transported.

The first and second detection device 29 and 31 are composed of proximity sensors, but may be composed of other detection device such as limit switches. In addition, the first and second detection device 29 and 31 detect the most expanded states and the most contracted states of the first and second bellows 13 and 14, but may detect states in the middle of expansion/contraction thereof.

<Configuration of Pump Head>

The pump head 11 is formed from a fluorine resin such as PTFE, PFA, or the like. A suction passage 34 and a discharge passage 35 for the transport fluid are formed within the pump head 11. The suction passage 34 and the discharge passage 35 are opened in an outer peripheral surface of the pump head 11 and respectively connected to a suction port and a discharge port (both are not shown) provided at the outer peripheral surface. The suction port is connected to a storage tank for the transport fluid or the like, and the discharge port is connected to a transport destination for the transport fluid. In addition, the suction passage 34 and the discharge passage 35 each branch toward both right and left side surfaces of the pump head 11, and have suction openings 36 and discharge openings 37 that are opened in both right and left side surfaces of the pump head 11. Each suction opening 36 and each discharge opening 37 communicate with the interior of the bellows 13 or 14 via the check valves 15 and 16, respectively.

<Configurations of Check Valves>

The check valves 15 and 16 are provided at each suction opening 36 and each discharge opening 37.

The check valve 15 (hereinafter, also referred to as "suction check valve") mounted at each suction opening 36 includes: a valve case 15*a*; a valve body 15*b* that is housed in the valve case 15*a*; and a compression coil spring 15*c* that biases the valve body 15*b* in a valve closing direction. The valve case 15*a* is formed in a bottomed cylindrical shape, and a through hole 15*d* is formed in a bottom wall thereof so as to communicate with the interior of the bellows 13 or 14. The valve body 15*b* closes the suction opening 36 (performs valve closing) by the biasing force of the compression coil spring 15*c*, and opens the suction opening 36 (performs valve opening) when a back pressure generated by flow of the transport fluid occurring with expansion/contraction of the bellows 13 or 14 acts thereon.

Accordingly, the suction check valve 15 opens when the bellows 13 or 14 at which the suction check valve 15 is disposed expands, to permit suction of the transport fluid in a direction from the suction passage 34 toward the interior of the bellows 13 or 14, and closes when the bellows 13 or 14 contracts, to block backflow of the transport fluid in a direction from the interior of the bellows 13 or 14 toward the suction passage 34.

The check valve 16 (hereinafter, also referred to as "discharge check valve") mounted at each discharge opening 37 includes: a valve case 16*a*; a valve body 16*b* that is housed in the valve case 16*a*; and a compression coil spring 16*c* that biases the valve body 16*b* in a valve closing direction. The valve case 16*a* is formed in a bottomed cylindrical shape, and a through hole 16*d* is formed in a bottom wall thereof so as to communicate with the interior of the bellows 13 or 14. The valve body 16*b* closes the through hole 16*d* of the valve case 16*a* (performs valve closing) by the biasing force of the compression coil spring 16*c*, and opens the through hole 16*d* of the valve case 16*a* (performs valve opening) when a back pressure generated by flow of the transport fluid occurring with expansion/contraction of the bellows 13 or 14 acts thereon.

Accordingly, the discharge check valve 16 opens when the bellows 13 or 14 at which the discharge check valve 16 is disposed contracts, to permit outflow of the transport fluid in a direction from the interior of the bellows 13 or 14 toward the discharge passage 35, and closes when the bellows 13 or 14 expands, to block backflow of the transport fluid in a direction from the discharge passage 35 toward the interior of the bellows 13 or 14.

<Operation of Bellows Pump>

Figure 3:
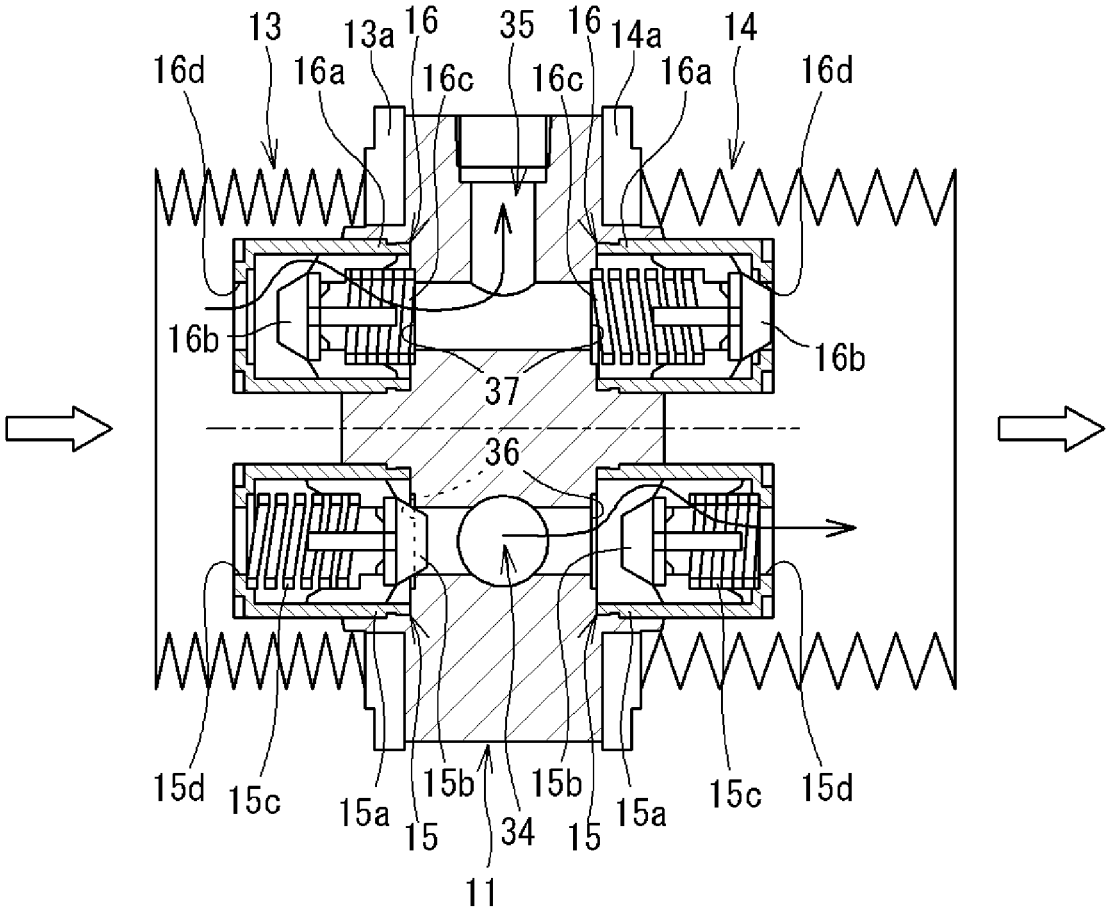
FIG. 3 is an explanatory diagram showing operation of the bellows pump.
Figure 4:
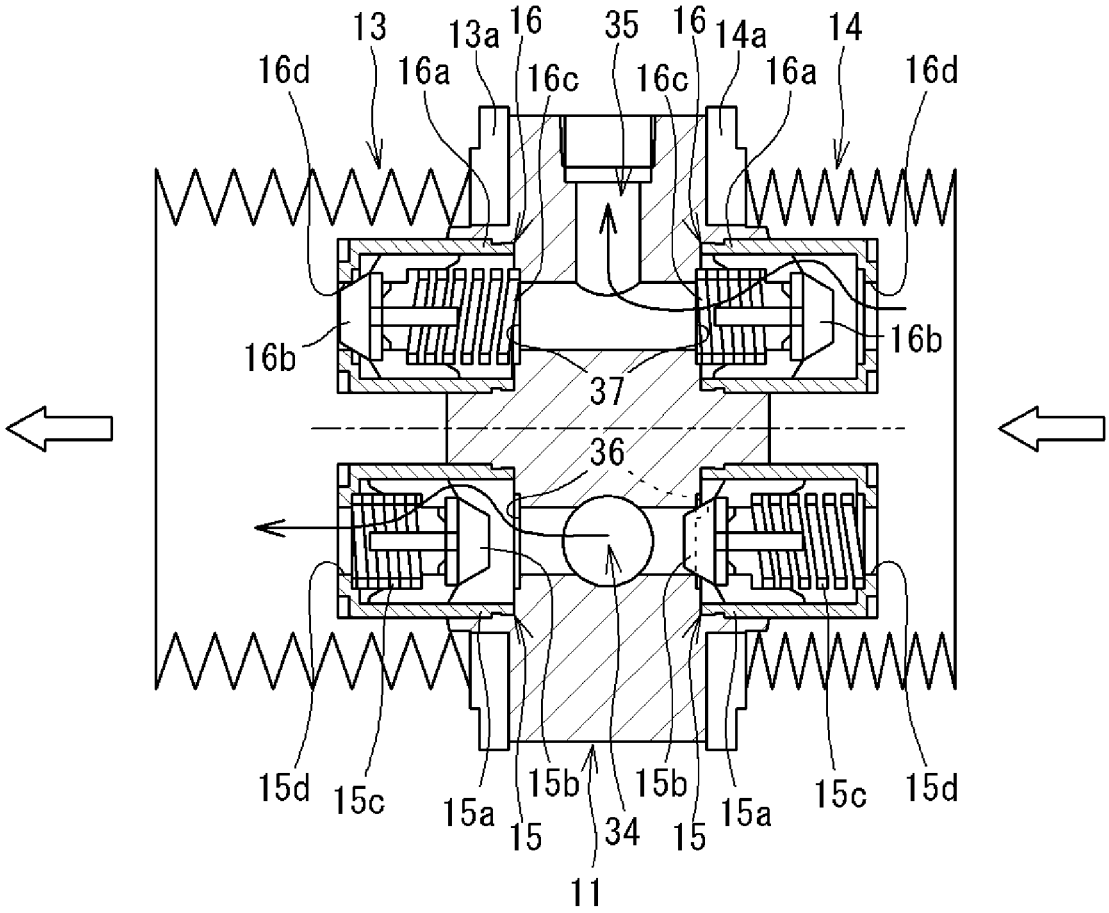
FIG. 4 is an explanatory diagram showing operation of the bellows pump.

Next, operation of the bellows pump 1 of the present embodiment will be described with reference to FIGS. 3 and 4. In FIGS. 3 and 4, the configurations of the first and second bellows 13 and 14 are shown in a simplified manner.

As shown in FIG. 3, when the first bellows 13 contracts and the second bellows 14 expands, the respective valve bodies 15*b* and 16*b* of the suction check valve 15 and the discharge check valve 16 that are mounted at the left side of the pump head 11 in the drawing receive pressure from the transport fluid within the first bellows 13 and move to the right sides of the respective valve cases 15*a* and 16*a* in the drawing. Accordingly, the suction check valve 15 closes, and the discharge check valve 16 opens, so that the transport fluid within the first bellows 13 is discharged through the discharge passage 35 to the outside of the pump.

Meanwhile, the respective valve bodies 15*b* and 16*b* of the suction check valve 15 and the discharge check valve 16 that are mounted at the right side of the pump head 11 in the drawing move to the right sides of the respective valve cases 15*a* and 16*a* in the drawing due to a suction effect by the second bellows 14. Accordingly, the suction check valve 15 opens, and the discharge check valve 16 closes, so that the transport fluid is sucked from the suction passage 34 into the second bellows 14.

Next, as shown in FIG. 4, when the first bellows 13 expands and the second bellows 14 contracts, the respective valve bodies 15*b* and 16*b* of the suction check valve 15 and the discharge check valve 16 that are mounted at the right side of the pump head 11 in the drawing receive pressure from the transport fluid within the second bellows 14 and move to the left sides of the respective valve cases 15*a* and 16*a* in the drawing. Accordingly, the suction check valve 15 closes, and the discharge check valve 16 opens, so that the transport fluid within the second bellows 14 is discharged through the discharge passage 35 to the outside of the pump.

Meanwhile, the respective valve bodies 15*b* and 16*b* of the suction check valve 15 and the discharge check valve 16 that are mounted at the left side of the pump head 11 in the drawing move to the left sides of the respective valve cases 15*a* and 16*a* in the drawing due to a suction effect by the first bellows 13. Accordingly, the suction check valve 15 opens, and the discharge check valve 16 closes, so that the transport fluid is sucked from the suction passage 34 into the first bellows 13.

By repeatedly performing the above operation, the left and right bellows 13 and 14 can alternately suck and discharge the transport fluid.

<Configurations of Solenoid Valves>

In FIG. 1, the first solenoid valve 4 switches between: supply/discharge of the pressurized air to/from one air chamber of the discharge-side air chamber 21 and the suction-side air chamber 26 of the first air cylinder portion 27; and supply/discharge of the pressurized air to/from the other air chamber. The first solenoid valve 4 is composed of, for example, a three-position solenoid switching valve including a pair of solenoids 4*a* and 4*b*. Each of the solenoids 4*a* and 4*b* is magnetized on the basis of a command signal received from the control unit 6.

The second solenoid valve 5 switches between: supply/discharge of the pressurized air to/from one air chamber of the discharge-side air chamber 21 and the suction-side air chamber 26 of the second air cylinder portion 28; and supply/discharge of the pressurized air to/from the other air chamber. The second solenoid valve 5 is composed of, for example, a three-position solenoid switching valve including a pair of solenoids 5*a* and 5*b*. Each of the solenoids 5*a* and 5*b* is magnetized upon reception of a command signal from the control unit 6.

Although each of the first and second solenoid valves 4 and 5 of the present embodiment is composed of the three-position solenoid switching valve, each of the first and second solenoid valves 4 and 5 may be a two-position solenoid switching valve which does not have a neutral position.

In FIG. 1, a first quick exhaust valve 61 is disposed between the discharge-side air chamber 21 (suction/exhaust port 22) of the first air cylinder portion 27 and the first solenoid valve 4 and adjacently to the discharge-side air chamber 21. The first quick exhaust valve 61 has an exhaust port 61*a* through which the pressurized air is discharged, and is configured to permit flow of the pressurized air from the first solenoid valve 4 to the discharge-side air chamber 21 and to discharge the pressurized air flowing out from the discharge-side air chamber 21, through the exhaust port 61*a*. Thus, the pressurized air within the discharge-side air chamber 21 can be quickly discharged through the first quick exhaust valve 61, not via the first solenoid valve 4.

Similarly, a second quick exhaust valve 62 is disposed between the discharge-side air chamber 21 (suction/exhaust port 22) of the second air cylinder portion 28 and the second solenoid valve 5 and adjacently to the discharge-side air chamber 21. The second quick exhaust valve 62 has an exhaust port 62*a* through which the pressurized air is discharged, and is configured to permit flow of the pressurized air from the second solenoid valve 5 to the discharge-side air chamber 21 and to discharge the pressurized air flowing out from the discharge-side air chamber 21, through the exhaust port 62*a*. Thus, the pressurized air within the discharge-side air chamber 21 can be quickly discharged through the second quick exhaust valve 62, not via the second solenoid valve 5.

A quick exhaust valve is not disposed between the suction-side air chamber 26 (suction/exhaust port 25*a*) of each of the air cylinder portions 27 and 28 and the corresponding solenoid valve 4 or 5. In the case where quick exhaust valves are mounted at the suction side, the same advantageous effects as those in the case where quick exhaust valves are mounted at the discharge side are obtained, but the effects are not great as compared to those at the discharge side. Thus, in the present embodiment, due to the cost, quick exhaust valves at the suction side are not installed.

<Configuration of Control Unit>

The control unit 6 controls drive of each of the first air cylinder portion 27 and the second air cylinder portion 28 of the bellows pump 1 by switching the respective solenoid valves 4 and 5 on the basis of detection results of the first detection device 29 and the second detection device 31 (see FIG. 2).

Specifically, on the basis of the detection results of the first detection device 29 and the second detection device 31, the control unit 6 controls drive of the first and second air cylinder portions 27 and 28 such that: the second bellows 14 is caused to contract from the most expanded state before the first bellows 13 comes into the most contracted state; and the first bellows 13 is caused to contract from the most expanded state before the second bellows 14 comes into the most contracted state.

Accordingly, at time of switching from contraction of one bellows (discharge) to expansion thereof (suction), the other bellows has already contracted to discharge the transport fluid. Thus, great fall of the discharge pressure of the transport fluid at the time of switching can be reduced. As a result, pulsation at the discharge side of the bellows pump 1 can be reduced.

Before one bellows 13 (14) comes into the most contracted state, the control unit 6 of the present embodiment causes the other bellows 14 (13) to contract from the most expanded state. However, the control unit 6 may perform control such that, when the one bellows 13 (14) comes into the most contracted state, the other bellows 14 (13) is caused to contract from the most expanded state. From the standpoint of reducing pulsation at the discharge side of the bellows pump 1, control is preferably performed as in the present embodiment.

<Configurations of Electropneumatic Regulators>

In FIGS. 1 and 2, the first electropneumatic regulator 51 is disposed between the mechanical regulator 3 and the first solenoid valve 4. The first electropneumatic regulator 51 adjusts: a first air pressure that is the air pressure of the pressurized air to be supplied to the suction-side air chamber 26 of the first air cylinder portion 27; and a second air pressure that is the air pressure of the pressurized air to be supplied to the discharge-side air chamber 21 of the first air cylinder portion 27.

The second electropneumatic regulator 52 is disposed between the mechanical regulator 3 and the second solenoid valve 5. The second electropneumatic regulator 52 adjusts: a first air pressure that is the air pressure of the pressurized air to be supplied to the suction-side air chamber 26 of the second air cylinder portion 28; and a second air pressure that is the air pressure of the pressurized air to be supplied to the discharge-side air chamber 21 of the second air cylinder portion 28.

The electropneumatic regulators 51 and 52 are disposed at the upstream sides of the solenoid valves 4 and 5, but may be disposed at the downstream sides of the solenoid valves 4 and 5. However, in this case, impact pressures generated when the solenoid valves 4 and 5 are switched act at the primary sides of the electropneumatic regulators 51 and 52. Thus, from the standpoint of preventing breakdown of the electropneumatic regulators 51 and 52, the electropneumatic regulators 51 and 52 are preferably disposed at the upstream sides of the solenoid valves 4 and 5.

<Example of Control of Electropneumatic Regulators>

In FIG. 2, on the basis of the detection results of the first and second detection device 29 and 31, the control unit 6 controls each of the electropneumatic regulators 51 and 52 such that, at least at a time point of end of expansion during expansion operation of the bellows 13 (14), the first air pressure of the pressurized air to be supplied to the suction-side air chamber 26 is lower than the second air pressure of the pressurized air to be supplied to the discharge-side air chamber 21.

The control unit 6 of the present embodiment controls each of the electropneumatic regulators 51 and 52 such that the first air pressure is constant at a pressure value lower than the second air pressure during the period from a time point of start of expansion of the bellows 13 (14) to a time point of end of expansion of the bellows 13 (14).

Figure 5:
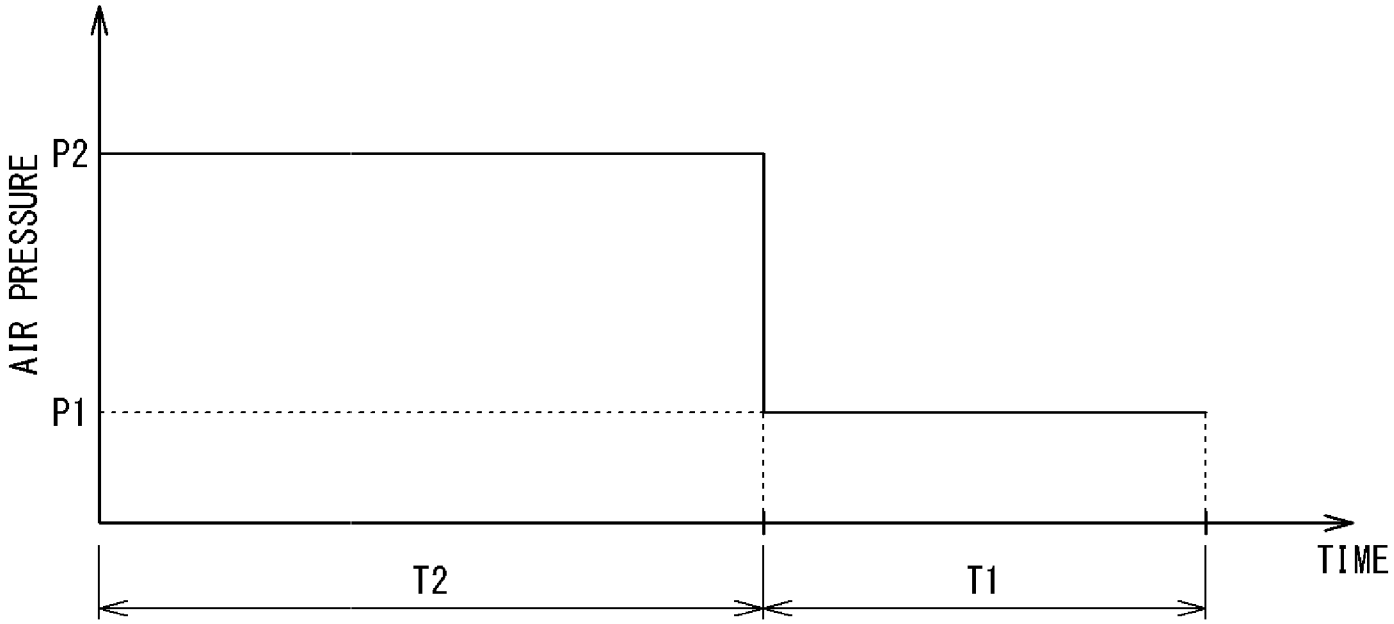
FIG. 5 is a graph showing an example of control of an electropneumatic regulator.

FIG. 5 is a graph showing an example of control of the electropneumatic regulator 51 (52) by the control unit 6 of the present embodiment. In FIG. 5, the control unit 6 controls the electropneumatic regulator 51 (52) such that the second air pressure is a constant air pressure P2 (e.g., 0.50 MPa) during a contraction period T2 in which the bellows 13 (14) contracts when discharging the transport fluid. In addition, the control unit 6 controls the electropneumatic regulator 51 (52) such that the first air pressure is a constant air pressure P1 (e.g., 0.15 MPa) lower than the air pressure P2 during an expansion period T1 in which the bellows 13 (14) expands when sucking the transport fluid.

Accordingly, in the contraction period T2 from a time point of start of contraction of the bellows 13 (14) to a time point of end of contraction (time point of most contraction) of the bellows 13 (14), the pressurized air having the high air pressure P2 is supplied to the discharge-side air chamber 21 of the air cylinder portion 27 (28). In addition, in the expansion period T1 from the time point of start of expansion of the bellows 13 (14) to the time point of end of expansion (time point of most expansion) of the bellows 13 (14), the pressurized air having the low air pressure P1 is supplied to the suction-side air chamber 26 of the air cylinder portion 27 (28).

When the pressurized air to be supplied to the suction-side air chamber 26 of the air cylinder portion 27 (28) becomes the low air pressure, the expansion speed of the bellows 13 (14) decreases accordingly. Therefore, the air pressure P1 is set such that, in the contraction period from a time point of start of expansion of the one bellows 13 (14) to a time point of end of contraction of the other bellows 14 (13) that is contracting at the time point of start of expansion, the one bellows 13 comes into the most expanded state.

In the present embodiment, the first and second air pressures of the first electropneumatic regulator 51 controlled by the control unit 6 and the first and second air pressures of the second electropneumatic regulator 52 controlled by the control unit 6 are set at the same values P1 and P2, respectively, but may be set at values that are different depending on each electropneumatic regulator.

Figure 6:
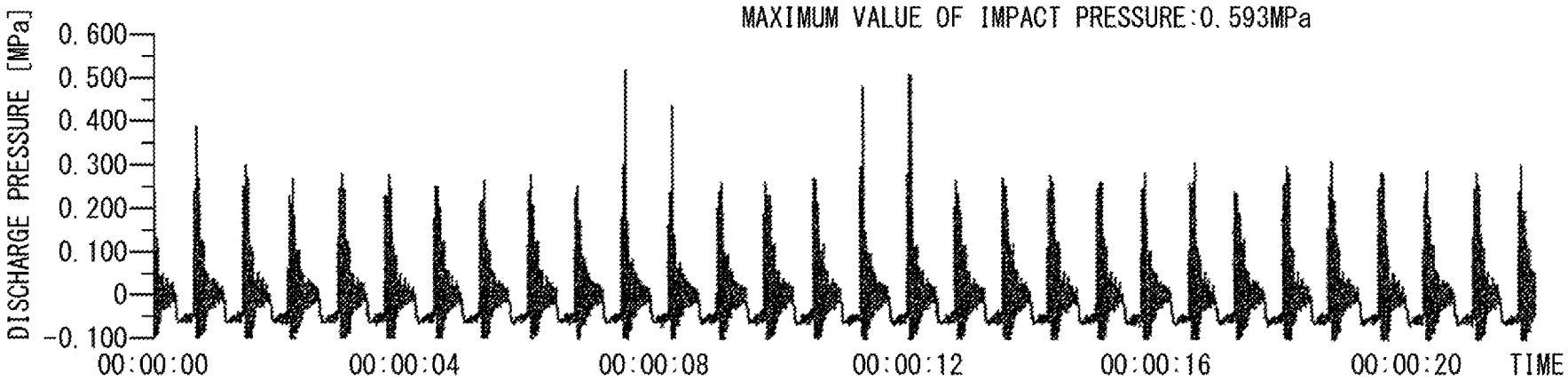
FIG. 6 is a graph showing the discharge pressure of a transport fluid discharged from a conventional bellows pump.

FIG. 6 is a graph showing the discharge pressure of the transport fluid discharged from a conventional bellows pump. This graph shows the discharge pressure in the case where each of the first air pressure and the second air pressure of the pressurized air to be supplied to the suction-side air chamber and the discharge-side air chamber of the bellows pump is set at 0.5 MPa.

As shown in FIG. 6, the maximum value of an impact pressure generated in the conventional bellows pump is 0.593 MPa.

Figure 7:
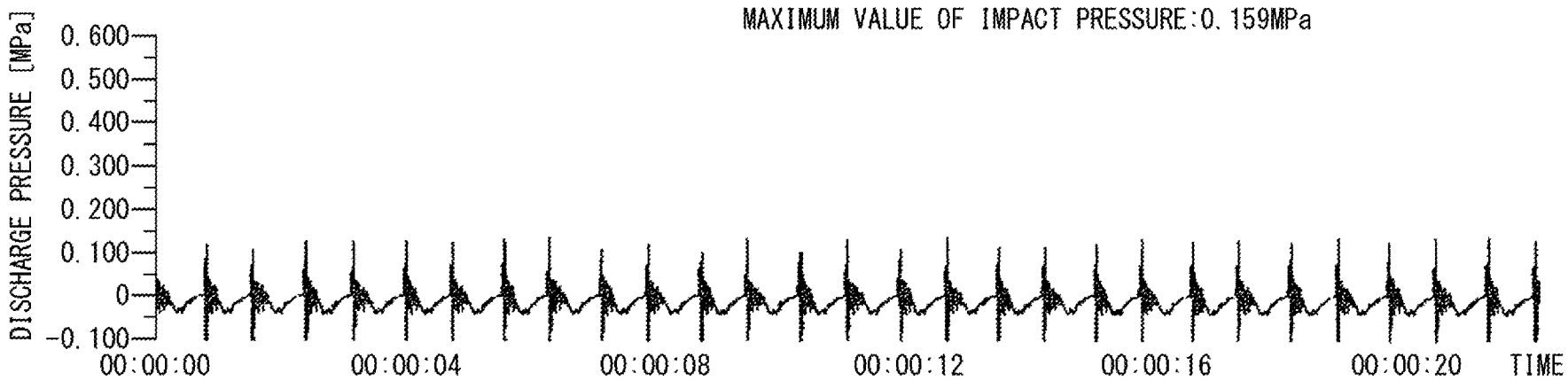
FIG. 7 is a graph showing the discharge pressure of a transport fluid discharged from the bellows pump of the present invention.

FIG. 7 is a graph showing the discharge pressure of the transport fluid discharged from the bellows pump 1 of the present embodiment. This graph shows the discharge pressure in the case where the second air pressure of the pressurized air to be supplied to the discharge-side air chamber of the bellows pump is set at 0.50 MPa and the first air pressure of the pressurized air to be supplied to the suction-side air chamber of the bellows pump is set at 0.15 MPa.

As shown in FIG. 7, the maximum value of an impact pressure generated in the bellows pump 1 of the present embodiment is 0.159 MPa, and thus the impact pressure is found to be significantly decreased as compared to the conventional bellows pump.

<Advantageous Effects>

As described above, according to the bellows pump device of the present embodiment, the electropneumatic regulator 51 (52) is controlled such that the first air pressure of the pressurized air to be supplied to the suction-side air chamber 26 during expansion operation of the bellows 13 (14) is lower than the second air pressure of the pressurized air to be supplied to the discharge-side air chamber 21 during contraction operation of the bellows 13 (14). Accordingly, a pressure variation occurring when switching is made from suction of the transport fluid by expansion operation of the bellows 13 (14) to discharge of the transport fluid by contraction operation of the bellows 13 (14) can be reduced, and thus generation of an impact pressure at the time of the switching can be suppressed. Therefore, even with an already-installed bellows pump, the impact pressure generated when switching is made from suction of the working fluid to discharge of the working fluid can easily be reduced by adding the electropneumatic regulator 51 (52) and the control unit 6.

In addition, the control unit 6 controls the electropneumatic regulator 51 (52) such that the first air pressure is constant from the time point of start of expansion of the bellows 13 (14) to the time point of end of expansion of the bellows 13 (14). Thus, the electropneumatic regulator 51 (52) is easily controlled as compared to the case where control is performed such that the first air pressure is continuously or discontinuously changed.

Moreover, the first air pressure of the pressurized air to be supplied to the suction-side air chamber 26 during expansion operation of the one bellows 13 (14) is set such that the one bellows 13 (14) comes into the most expanded state before the other bellows 14 (13) that is contracting during the expansion operation contracts most. Thus, the following advantageous effects are achieved. Specifically, even when the expansion speed of the one bellows 13 (14) is decreased due to the low air pressure, expansion operation of the one bellows 13 (14) ends in a contraction period to the time point of end of contraction of the other bellows 14 (13) that is contracting during the expansion operation. Thus, an impact pressure can be reduced without decreasing the amount of the transport fluid discharged by contraction operation of each of the bellows 13 and 14.

<Another Example of Control of Electropneumatic Regulators>

Figure 8:
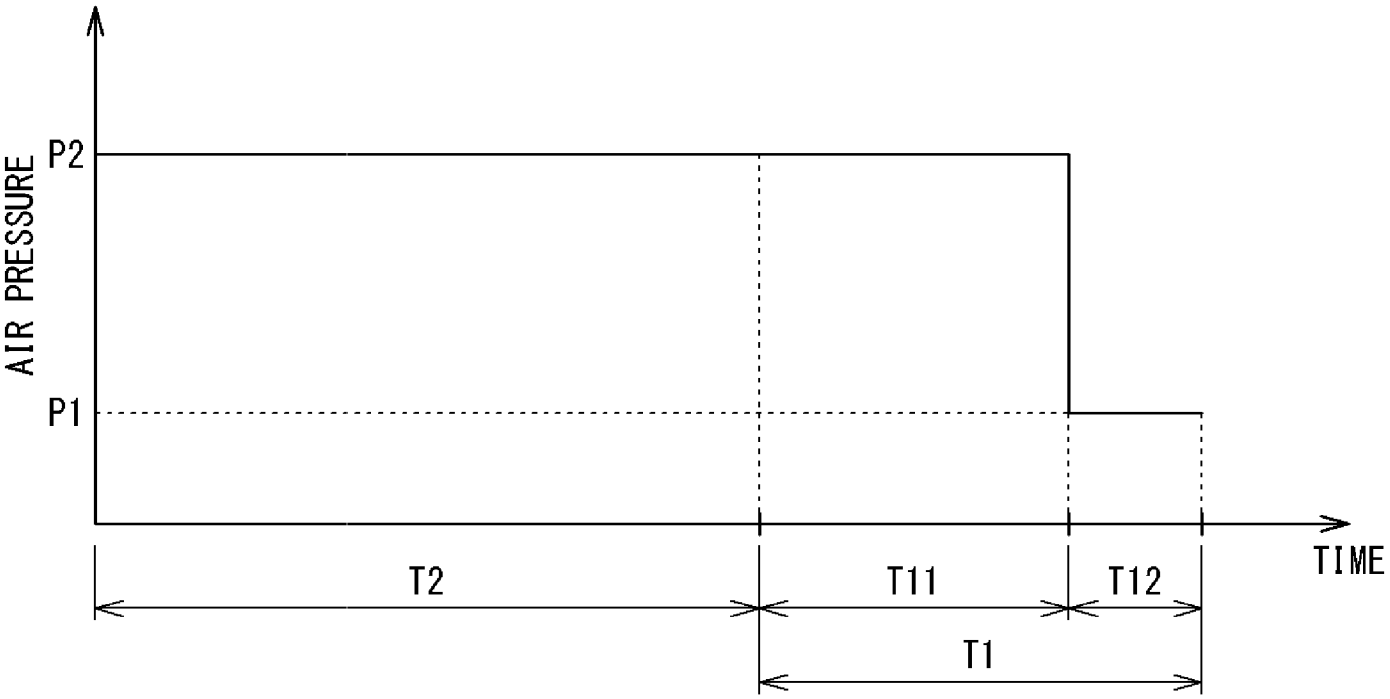
FIG. 8 is a graph showing another example of control of the electropneumatic regulator.

FIG. 8 is a graph showing another example of control of the electropneumatic regulator 51 (52) by the control unit 6.

In FIG. 8, the control unit 6 controls each of the electropneumatic regulators 51 and 52 such that the first air pressure of the pressurized air to be supplied to the suction-side air chamber 26 discontinuously changes during the period from the time point of start of expansion of the bellows 13 (14) to the time point of end of expansion of the bellows 13 (14), that is, during the expansion period T1 in which the bellows 13 (14) expands when sucking the transport fluid.

Specifically, the control unit 6 controls the electropneumatic regulator 51 (52) such that the first air pressure is higher during a first half expansion period T11 from the time point of start of expansion of the bellows 13 (14) to a predetermined halfway time point of the expansion operation, than during a second half expansion period T12 from the halfway time point to the time point of end of expansion.

The halfway time point is preferably a time point from which the bellows 13 (14) can expand to an expansion end position by an inertial force thereof. Specifically, the halfway time point is preferably set such that the second half expansion period T12 is 30% to 50% of the expansion period T1.

Here, the halfway time point is set such that the second half expansion period T12 is 30% of the expansion period T1. The control unit 6 controls the electropneumatic regulator 51 (52) such that the first air pressure during the first half expansion period T11 is the constant air pressure P2, which is equal to the second air pressure of the pressurized air to be supplied to the discharge-side air chamber 21. In addition, the control unit 6 controls the electropneumatic regulator 51 (52) such that the first air pressure during the second half expansion period T12 is the constant air pressure P1 lower than the air pressure P2.

Accordingly, during the contraction period T2 from the time point of start of contraction of the bellows 13 (14) to the time point of end of contraction of the bellows 13 (14), and during the first half expansion period T11 from the time point of start of expansion of the bellows 13 (14) to the halfway time point, the pressurized air having the high air pressure P2 is supplied to the discharge-side air chamber 21 and the suction-side air chamber 26 of the air cylinder portion 27 (28). In addition, during the second half expansion period T12 from the halfway time point of the bellows 13 (14) to the time point of end of expansion of the bellows 13 (14), the pressurized air having the low air pressure P1 is supplied to the suction-side air chamber 26 of the air cylinder portion 27 (28).

As described above, according to the other example of control shown in FIG. 8, the control unit 6 controls the electropneumatic regulator 51 (52) such that the first air pressure of the pressurized air to be supplied to the suction-side air chamber 26 discontinuously changes during the period from the time point of start of expansion of the bellows 13 (14) to the time point of end of expansion of the bellows 13 (14). Thus, the time of the change (here, the halfway time point) can be freely set. Therefore, the degree of freedom in pressure change of the first air pressure during the period from the time point of start of expansion of the bellows 13 (14) to the time point of end of expansion of the bellows 13 (14) can be increased.

Since the control unit 6 controls the electropneumatic regulator 51 (52) such that the first air pressure is higher during the first half expansion period of the bellows 13 (14) than during the second half expansion period of the bellows 13 (14), the expansion speed of the bellows 13 (14) during the first half expansion period can be higher than the expansion speed of the bellows 13 (14) during the second half expansion period. Accordingly, the expansion time of the bellows can be inhibited from becoming excessively long due to the first air pressure becoming low during expansion of the bellows 13 (14). As a result, the discharge flow rate of the fluid can be inhibited from decreasing.

Since the bellows 13 (14) can be caused to expand to the expansion end position by the inertial force thereof from the halfway time point of the expansion operation, the first air pressure can be lower than the air pressure required for the expansion operation of the bellows 13 (14), during the second half expansion period from the halfway time point to the time point of end of expansion. Accordingly, a pressure variation occurring when switching is made from expansion operation of the bellows 13 (14) to contraction operation of the bellows 13 (14) can be further effectively suppressed.

Figure 9:
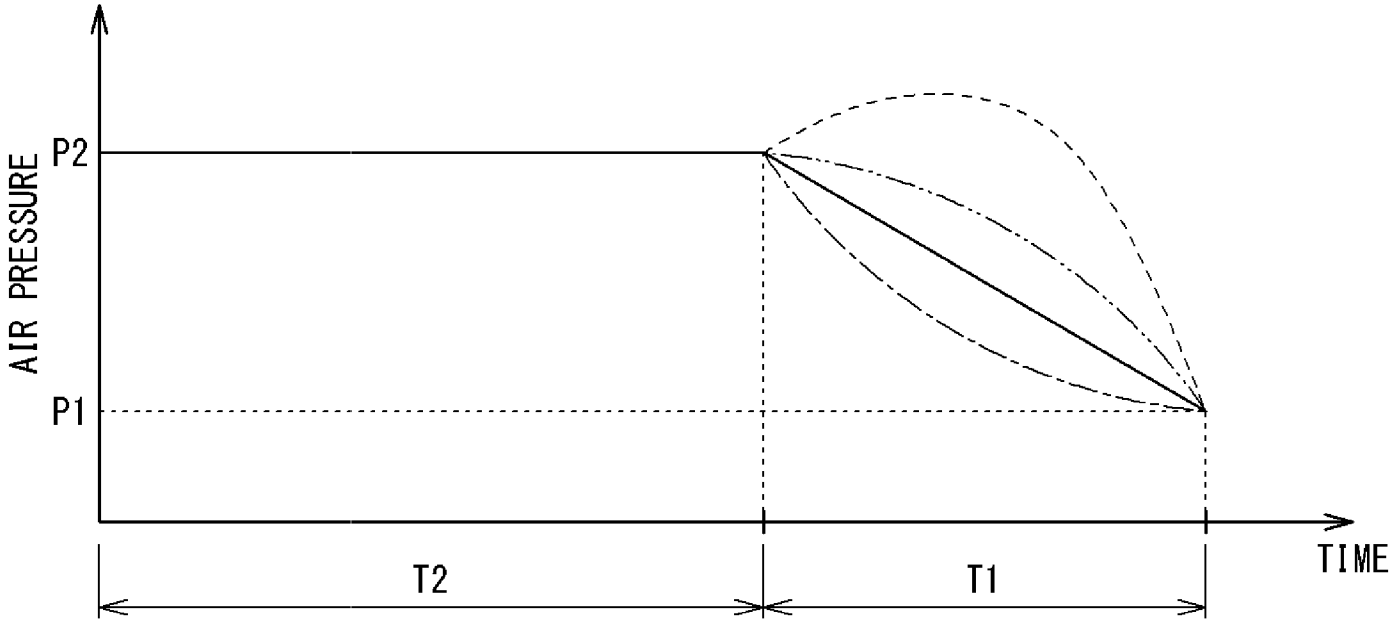
FIG. 9 is a graph showing still other examples of control of the electropneumatic regulator.

FIG. 9 is a graph showing still other examples of control of the electropneumatic regulator 51 (52) by the control unit 6.

In FIG. 9, the control unit 6 controls each of the electropneumatic regulators 51 and 52 such that the first air pressure of the pressurized air to be supplied to the suction-side air chamber 26 continuously changes during the period from the time point of start of expansion of the bellows 13 (14) to the time point of end of expansion of the bellows 13 (14), that is, during the expansion period T1 in which the bellows 13 (14) expands when sucking the transport fluid.

Specifically, first, the control unit 6 controls each of the electropneumatic regulators 51 and 52 such that, at the time point of start of expansion of the bellows 13 (14), the first air pressure is the air pressure P2, which is equal to the second air pressure of the pressurized air to be supplied to the discharge-side air chamber 21. Then, for example, as shown by a solid line in the drawing, the control unit 6 controls the respective electropneumatic regulators 51 and 52 such that the first air pressure is decreased in direct proportion to the expansion time of the bellows 13 (14) and becomes the lowest air pressure P1 at the time point of end of expansion of the bellows 13 (14).

Here, as an example of control in which the first air pressure is continuously changed, the first air pressure is decreased in direct proportion to the expansion time of the bellows 13 (14). However, the first air pressure may be decreased in inverse proportion to the expansion time as shown by an alternate long and short dash line in the drawing, or may be changed as shown by an alternate long and two short dashes line or a broken line in the drawing.

In each of the four types of control examples shown in FIG. 8, the first air pressure at the time point of start of expansion of the bellows 13 (14) is set at a value (air pressure P2) equal to the second air pressure, but may be set at a value different from the second air pressure. In this case, the first air pressure at the time point of start of expansion of the bellows 13 (14) may be set so as to be lower than the air pressure P1 at the time point of end of expansion.

As described above, according to the other examples of control shown in FIG. 9, the control unit 6 controls the electropneumatic regulator 51 (52) such that the first air pressure of the pressurized air to be supplied to the suction-side air chamber 26 continuously changes during the period from the time point of start of expansion of the bellows 13 (14) to the time point of end of expansion of the bellows 13 (14). Thus, the degree of freedom in pressure change of the first air pressure during the period from the time point of start of expansion of the bellows 13 (14) to the time point of end of expansion of the bellows 13 (14) can be increased.

In the examples of control shown in FIGS. 5, 8, and 9 of the present embodiment, the control unit 6 controls the electropneumatic regulator 51 (52) such that the second air pressure is the constant air pressure P2. However, the control unit 6 does not necessarily need to control the electropneumatic regulator 51 (52) such that the second air pressure is the constant air pressure P2.

For example, for the purpose of reducing fall of the discharge pressure of the fluid discharged from the bellows pump 1, the control unit 6 may perform control such that the second air pressure is increased as the bellows 13 (14) contracts. In this case, the control unit 6 only needs to control the electropneumatic regulator 51 (52) such that the first air pressure at least at the time point of end of expansion during expansion operation of the bellows 13 (14) is lower than the maximum value of the second air pressure.

Second Embodiment

Figure 10:
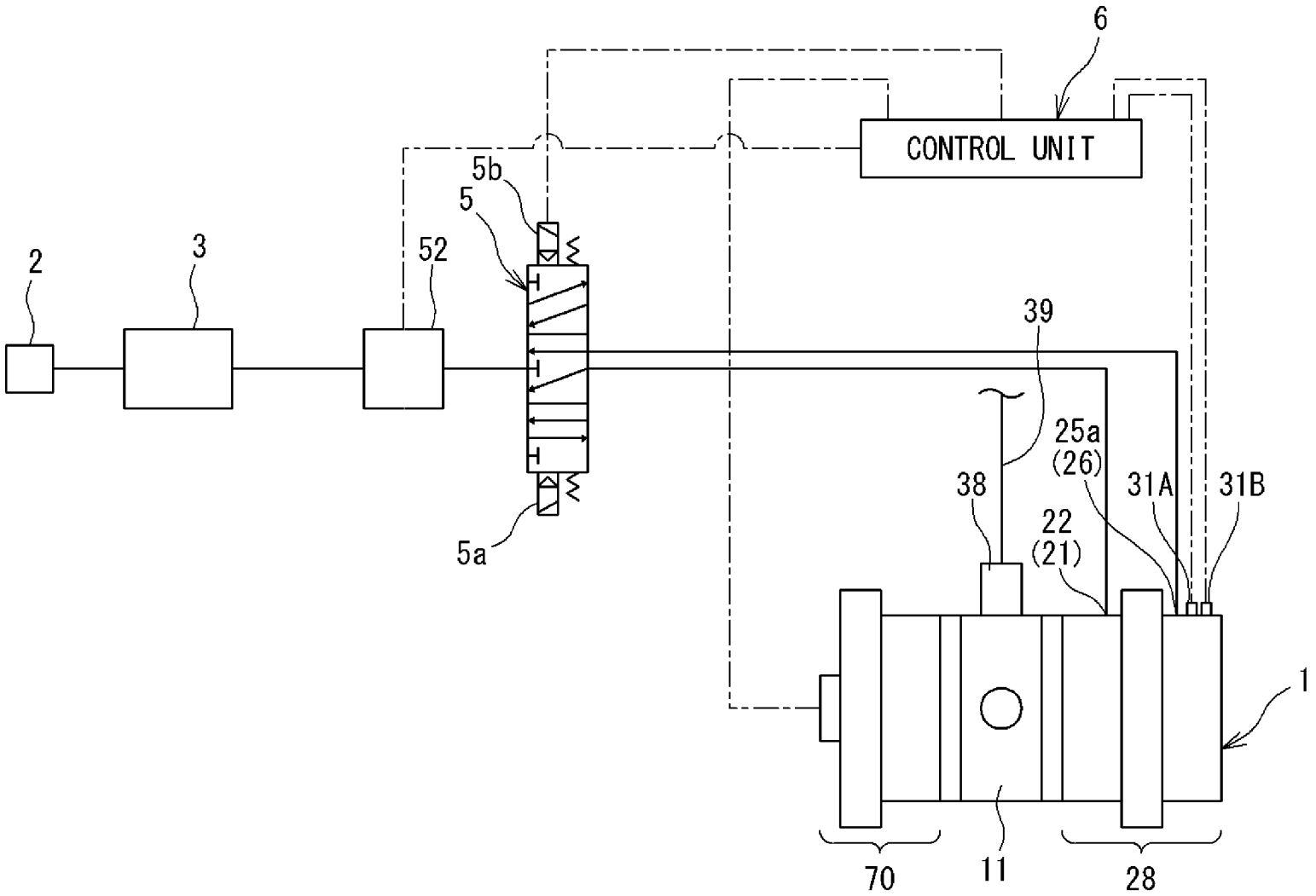
FIG. 10 is a schematic configuration diagram of a bellows pump device according to a second embodiment of the present invention.

FIG. 10 is a schematic configuration diagram of a bellows pump device according to a second embodiment of the present invention. The bellows pump device of the present embodiment includes: a bellows pump 1; an air supply device 2 such as an air compressor that supplies pressurized air (working fluid) to the bellows pump 1; a mechanical regulator 3 and a single electropneumatic regulator 52 that adjust the air pressure of the pressurized air; a single solenoid valve 5; and a control unit 6.

Figure 11:
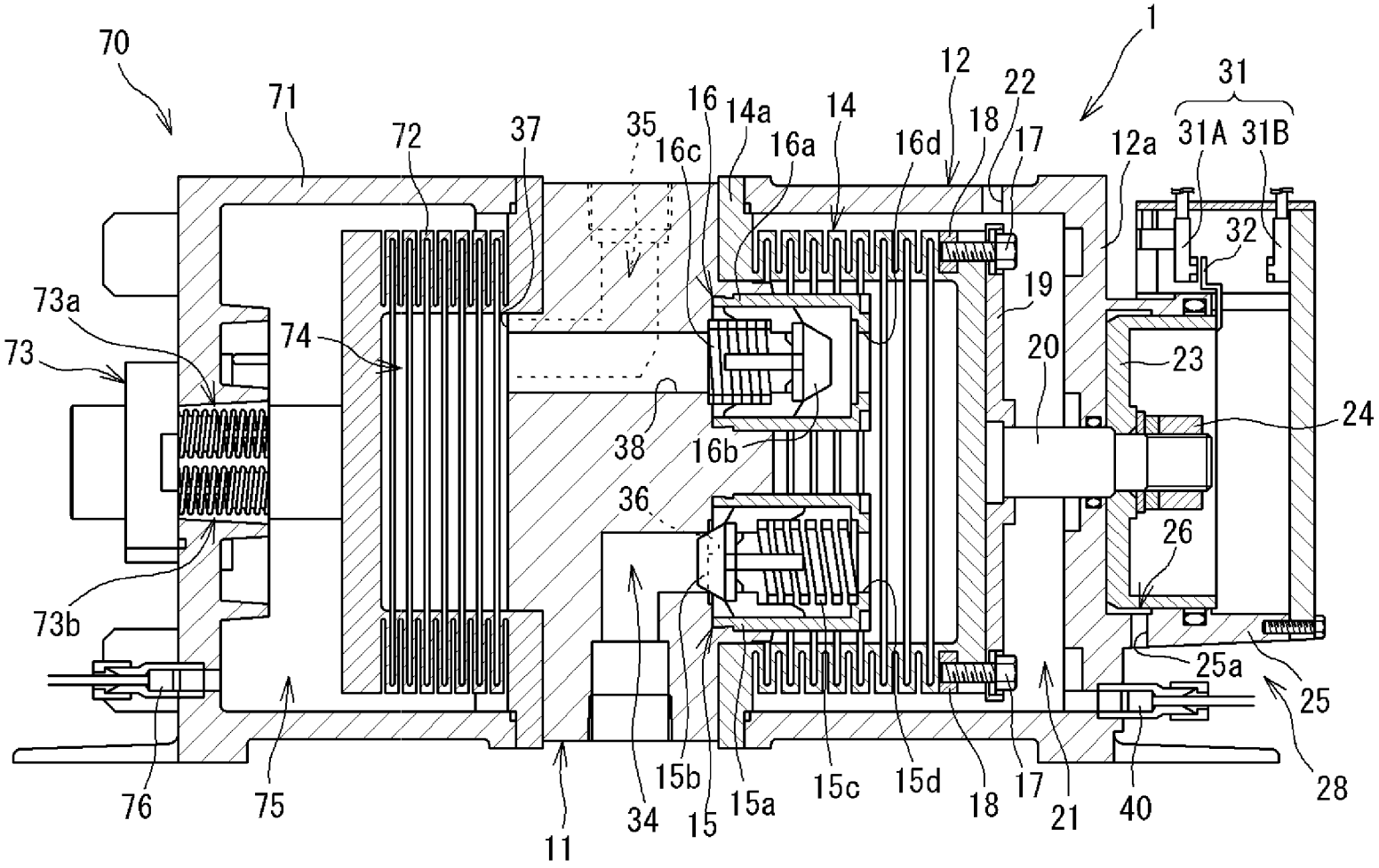
FIG. 11 is a cross-sectional view of a bellows pump according to the second embodiment.

FIG. 11 is a cross-sectional view of the bellows pump according to the second embodiment.

The bellows pump 1 of the present embodiment is of an accumulator-built-in type, and includes: a pump head 11; an air cylinder portion 28 that is mounted at one side in the right-left direction (at the right side in FIG. 10) of the pump head 11; and an accumulator unit 70 that is mounted at the other side in the right-left direction (at the left side in FIG. 10) of the pump head 11.

A suction passage 34, a discharge passage 35, and a communication passage 38 are formed within the pump head 11. The suction passage 34 is formed in an L shape, is opened at one end thereof in the outer peripheral surface of the pump head 11, and is connected at one end thereof to a suction port (not shown) provided at the outer peripheral surface. A suction opening 36 that is opened in the side surface at the air cylinder portion 28 side (the right side surface in FIG. 10) of the pump head 11 is formed at the other end of the suction passage 34. The suction opening 36 communicates with the interior of a bellows 14 via a suction check valve 15.

The discharge passage 35 is formed in an L shape, is opened at one end thereof in the outer peripheral surface of the pump head 11, and is connected at one end thereof to a discharge port (not shown) provided at the outer peripheral surface. A discharge opening 37 that is opened in the side surface at the accumulator unit 70 side (the left side surface in FIG. 10) of the pump head 11 is formed at the other end of the discharge passage 35.

The communication passage 38 is formed so as to penetrate the pump head 11 in the horizontal direction, is opened at one end thereof in the side surface at the accumulator unit 70 side (the left side surface in FIG. 10) of the pump head 11, and is opened at the other end thereof in the side surface at the air cylinder portion 28 side (the right side surface in FIG. 10) of the pump head 11. The opening at the other end side communicates with the interior of the bellows 14 via a discharge check valve 16.

The accumulator unit 70 includes: an accumulator case 71 that is mounted on the pump head 11; an accumulator bellows 72 that is mounted within the accumulator case 71 and on the side surface of the pump head 11; and an automatic pressure adjustment mechanism 73.

The accumulator bellows 72 is formed in a bottomed cylindrical shape, and an open end portion thereof is fixed to the pump head 11. A peripheral wall of the accumulator bellows 72 is formed in an accordion shape and is configured to be expandable/contractible in the horizontal direction. A space surrounded by the side surface of the pump head 11 and an inner wall of the accumulator bellows 72 is formed as an accumulator chamber 74 whose volume can change.

The accumulator case 71 is formed in a bottomed cylindrical shape, a space surrounded by the side surface of the pump head 11, an outer wall of the accumulator bellows 72, and an inner wall of the accumulator case 71 is formed as an accumulator air chamber 75, and the accumulator air chamber 75 is filled with air for pulsation reduction.

The automatic pressure adjustment mechanism 73 includes an automatic feed valve mechanism 73*a* and an automatic exhaust valve mechanism 73*b* for balancing the air pressure within the accumulator air chamber 75 with the discharge pressure of the transport fluid discharged by the air cylinder portion 28, in accordance with variation of the discharge pressure. The automatic pressure adjustment mechanism 73 is mounted at a bottom wall of the accumulator case 71.

A leakage sensor 76 for detecting leakage of the transport fluid to the accumulator air chamber 75 is mounted below the bottom wall of the accumulator case 71.

Because of the above configuration, when the bellows 14 of the air cylinder portion 28 contracts, the respective valve bodies 15*b* and 16*b* of the suction check valve 15 and the discharge check valve 16 receive pressure from the transport fluid within the bellows 14 and move to the left sides of the respective valve cases 15*a* and 16*a* in the drawing. Accordingly, the suction check valve 15 closes, and the discharge check valve 16 opens, so that the transport fluid within the bellows 14 flows out through the communication passage 38 to the accumulator chamber 74 and the transport fluid stored temporarily in the accumulator chamber 74 is discharged out of the pump through the discharge passage 35.

Conversely, when the bellows 14 of the air cylinder portion 28 expands, the respective valve bodies 15*b* and 16*b* of the suction check valve 15 and the discharge check valve 16 move to the right sides of the respective valve cases 15*a* and 16*a* in the drawing due to a suction effect by the bellows 14. Accordingly, the suction check valve 15 opens, and the discharge check valve 16 closes, so that the transport fluid is sucked through the suction passage 34 into the bellows 14.

By repeatedly performing the above operation, the bellows 14 can alternately suck and discharge the transport fluid. At this time, when the discharge pressure of the transport fluid discharged by the air cylinder portion 28 is at a crest of a discharge pressure curve due to pulsation thereof, the accumulator bellows 72 expands so as to increase the volume of the accumulator chamber 74. Accordingly, the flow rate of the transport fluid flowing out from the accumulator chamber 74 becomes lower than the flow rate of the transport fluid flowing into the accumulator chamber 74.

When the discharge pressure comes close to a trough of the discharge pressure curve due to the pulsation thereof, the discharge pressure becomes lower than the filled air pressure in the accumulator air chamber 75 that is compressed by expansion of the accumulator bellows 72, and thus the accumulator bellows 72 contracts so as to decrease the volume of the accumulator chamber 74. Accordingly, the flow rate of the transport fluid flowing out from the accumulator chamber 74 becomes higher than the flow rate of the transport fluid flowing into the accumulator chamber 74. That is, the pulsation is absorbed and attenuated, and the fluid is transported at the discharge pressure that is substantially smoothened.

In FIGS. 10 and 11, similarly to the first embodiment, the control unit 6 controls the electropneumatic regulator 52 such that, during the period from a time point of start of expansion of the bellows 14 to a time point of end of expansion of the bellows 14, the first air pressure is constant at a pressure value lower than the second air pressure.

Accordingly, in a contraction period from a time point of start of contraction of the bellows 14 to a time point of end of contraction (time point of most contraction) of the bellows 14, the pressurized air having a high air pressure is supplied to the discharge-side air chamber 21 of the air cylinder portion 28. In addition, in an expansion period from a time point of start of expansion of the bellows 14 to a time point of end of expansion (time point of most expansion) of the bellows 14, the pressurized air having a low air pressure is supplied to the suction-side air chamber 26 of the air cylinder portion 28.

The points of which the description is omitted in the second embodiment are the same as in the first embodiment.

As described above, also in the bellows pump device of the present embodiment, the electropneumatic regulator 52 is controlled such that the first air pressure of the pressurized air to be supplied to the suction-side air chamber 26 during expansion operation of the bellows 14 is lower than the second air pressure of the pressurized air to be supplied to the discharge-side air chamber 21 during contraction operation of the bellows 14. Accordingly, a pressure variation occurring when switching is made from suction of the transport fluid by expansion operation of the bellows 14 to discharge of the transport fluid by contraction operation of the bellows 14 can be suppressed, and thus generation of an impact pressure at the time of the switching can effectively be suppressed. Therefore, even with an already-installed bellows pump, the impact pressure generated when switching is made from suction of the working fluid to discharge of the working fluid can easily be reduced by adding the electropneumatic regulator 52 and the control unit 6.

The present invention is not limited to the above embodiments, and changes may be made as appropriate within the scope of the present invention described in the claims.

For example, control of the electropneumatic regulator 51 (52) by the control unit 6 is not limited to the examples of control described in the above embodiments, and the electropneumatic regulator 51 (52) only needs to be controlled such that, at least at a time point of end of expansion of the bellows 13 (14), the first air pressure is lower than the second air pressure.

REFERENCE SIGNS LIST

6 control unit
13 first bellows (bellows)
14 second bellows (bellows)
21 discharge-side air chamber (other air chamber)
26 suction-side air chamber (one air chamber)
51 first electropneumatic regulator (electropneumatic regulator)
52 second electropneumatic regulator (electropneumatic regulator)

The invention claimed is:

1. A bellows pump device that supplies pressurized air to one first air chamber of two first hermetic air chambers thereby to cause a first bellows to perform an expansion operation to suck a transport fluid, and supply pressurized air to the other first air chamber thereby to cause the first bellows to perform a contraction operation to discharge the transport fluid, the bellows pump device comprising:

a first solenoid valve and a second solenoid valve, the first solenoid valve configured to switch between a supply of pressurized air to the one first air chamber and a supply of pressurized air to the other first air chamber;

a control unit configured to control switching of the solenoid valves by transmitting a command signal to the solenoid valves; and a first electropneumatic regulator configured to adjust a first air pressure that is an air pressure of pressurized air supplied to the one first air chamber as switched by the first solenoid valve in response to the command signal, and a second air pressure that is an air pressure of pressurized air supplied to the other first air chamber as switched by the first solenoid valve in response to the command signal; wherein the control unit controls the first electropneumatic regulator such that, at least at a time point of end of expansion during the expansion operation of the first bellows, the first air pressure is lower than the second air pressure, the control unit controls the first electropneumatic regulator such that the first air pressure is higher during a first expansion period from a time point of start of expansion to a predetermined time point of the expansion operation than during a second expansion period from the predetermined time point to the time point of end of expansion, and the control unit controls the first electropneumatic regulator such that the first air pressure of the first expansion period is constant and the first air pressure of the second expansion period is constant.

2. The bellows pump device according to claim 1, wherein the predetermined time point is a time point from which the first bellows can expand to an expansion end position by an inertial force due to the expansion operation of the bellows pump itself.

3. The bellows pump device according to claim 1, wherein each of the solenoid valves includes a first solenoid and a second solenoid.

4. The bellows pump device according to claim 3, wherein each of the first solenoid and the second solenoid is magnetized based on the command signal from the control unit.

5. The bellows pump device according to claim 1, the bellows pump device to supply pressurized air to one second air chamber of two second hermetic air chambers to cause a second bellows opposite the first bellows to perform an expansion operation to suck the transport fluid and supply pressurized air to the other second air chamber thereby to cause the second bellows to perform a contraction operation to discharge the transport fluid.

6. The bellows pump device according to claim 5, further comprising a second electropneumatic regulator configured to adjust a first air pressure that is an air pressure of pressurized air supplied to the one second air chamber as switched by the second solenoid valve in response to the command signal, and a second air pressure that is an air pressure of pressurized air supplied to the other second air chamber as switched by the second solenoid valve in response to the command signal.

7. The bellows pump device according to claim 6, wherein the control unit controls the second electropneumatic regulator such that, at least at a time point of end of expansion during the expansion operation of the second bellows, the first air pressure of the one second air chamber is lower than the second air pressure of the other second air chamber, the control unit controls the second electropneumatic regulator such that the first air pressure of the one second air chamber is higher during a first expansion period from the time point of start of expansion of the second bellows to a predetermined time point of the expansion operation than during a second expansion period from the predetermined time point to the time point of end of expansion of the second bellows, and the control unit controls the second electropneumatic regulator such that the first air pressure of the one second air chamber of the first expansion period is constant and the first air pressure of the one second air chamber of the second expansion period is constant.

8. The bellows pump device according to claim 1, wherein the control unit controls the first electropneumatic regulator such that the first expansion period is longer than the second expansion period.

9. The bellows pump device according to claim 1, wherein the control unit controls the first electropneumatic regulator such that the first air pressure of the first expansion period is the same as the second air pressure.

10. The bellows pump device according to claim 7, wherein the control unit controls the second electropneumatic regulator such that the first expansion period is longer than the second expansion period.

11. The bellows pump device according to claim 7, wherein the control unit controls the second electropneumatic regulator such that the first air pressure of the one second air chamber of the first expansion period is the same of the second air pressure of the other second air chamber.

* * * * *